United States Patent [19]

Kumakura et al.

[11] Patent Number: 4,997,738

[45] Date of Patent: Mar. 5, 1991

[54] ELECTROPHOTOGRAPHIC PHOTORECEPTOR HAVING SILICATE WITH PERFLUOROALKYL GROUPS IN PROTECTIVE LAYER

[75] Inventors: Minoru Kumakura, Maebashi; Mitsuhiro Yoshitome, Yamanashi; Masaru Wakatabe, Hanno; Masahiro Horigome, Yamanashi; Kazuhiko Shima, Yamanashi, all of Japan

[73] Assignees: Shindengen Electric Manufacturing Co., Ltd., Tokyo; Yamanashi Electronics Co., Ltd., Kofu; Japan Atomic Energy Research Institute, Tokyo, all of Japan

[21] Appl. No.: 441,251

[22] Filed: Nov. 27, 1989

[30] Foreign Application Priority Data

Dec. 1, 1988 [JP] Japan ..... 63-305104

[51] Int. Cl.[5] ..... G03G 5/14

[52] U.S. Cl. ..... 430/67

[58] Field of Search ..... 430/66, 67

[56] References Cited

U.S. PATENT DOCUMENTS 4,250,240 2/1981 Shimada ..... 430/66

FOREIGN PATENT DOCUMENTS 61-205950 9/1986 Japan .

*Primary Examiner*—David Welsh

*Attorney, Agent, or Firm*—Stevens, Davis, Miller & Mosher

[57] ABSTRACT

An electrophotographic photoreceptor comprises a photoconductive layer having a protective layer disposed thereon, said protective layer being formed by dehydrocondensation of the hydrolyzate of a perfluoroalkyl silane coupling agent, or the hydrolyzate of a mixture of a perfluoroalkyl silane coupling agent and a silane coupling agent. The photoreceptor is very useful in that it can exhibit a high performance even in an environment at a higher temperature and at a higher humidity and that it has a high resistance to the abrasion with a great number of sheets being printed and with the cleaning members and that it is capable of preserving a high resolution without any image blurring.

8 Claims, No Drawings

ELECTROPHOTOGRAPHIC PHOTORECEPTOR HAVING SILICATE WITH PERFLUOROALKYL GROUPS IN PROTECTIVE LAYER

BACKGROUND OF THE INVENTION

1. Field of the Invention

The present invention relates to an electrophotographic photoreceptor, and more particularly, to an electrophotographic photoreceptor having a highly waterproofing surface and a high resistance to mechanical abrasion.

2. Description of the Related Art

Electrophotographic photoreceptors are required to have predetermined sensitivities, electronic properties and optical properties as well as resistance to abrasion and readiness to cleaning. Since the photoreceptors are susceptible to scratches due to development with toner, abrasions with sheets and cleaning members, their resistance to abrasion is very important. On the other hand, the readiness to cleaning is a property determining ease of removing the toner adhered to and remaining on the surface of the photoreceptor and required to be higher in order to produce sharp images causing no blurring of images, particularly under high moisture.

The image blurring phenomenon tends to occur when the surface resistivity of the photoreceptors is markedly reduced at a high humidity owing to existing of a hydrophilic and hygroscopic film on the surface, adsorption of ions to the surface due to the corona charges thereon, or attaching of sheet dust tot he surface upon transferring operation.

The photoreceptors have differences in potential between light parts and dark parts on their surfaces after charging and exposing them to lights. When the photoreceptors have a hydrophilic surface, the charges flow from high potential parts to low potential parts across the interfacial regions therebetween so that the potentials at the interfacial regions are averaged to give no reproduction of sharp contours in images resulting in the image blurring and spread.

The surfaces of conventional inorganic and organic photoreceptors have problems on the resistance to abrasion and the readiness to cleaning so that various methods have been proposed to provide a protective layer.

There have been reported hydrolyzates of silane coupling agents as materials for the protective layers. In such techniques, silane compounds having an alkoxy group, an amino group and/or a methacryl group such as methyl trimethoxysilane, vinylchlorosilane and γ-glycidoxypropyl trimethoxysilane have been used.

Recently, an attempt has been proposed to allow the protective layers to contain fluorinated silane coupling agents [Japanese Patent Kokai (Laid-open) No. 61-205950 (1986)].

In this attempt, the protective layers comprises a thermoplastic resin, or thermosetting resin mixed with fluorine compounds, or fluorinated silane coupling agents.

As described in prior patents, the processes using hydrolyzates of silane coupling agents as materials for the protective layers resulted in the layers having a resistance to abrasion, but a poor readiness to cleaning, while conversely those using fluorinated silane coupling agents could achieve some improvement in the readiness to cleaning, but caused a problem on the resistance to abrasion due to a lower hardness of the resins and simple blending rather than reacting with the fluorinated silane coupling agents.

OBJECTS AND SUMMARY OF THE INVENTION

The present invention provides an electrophotographic photoreceptor having a protective layer of a specific chemical structure which imparts a higher resistance to abrasion, a readiness to cleaning and a waterproofing property to overcome the problems of the prior techniques as described above.

Thus, we have made researches to achieve an improvement in the readiness to cleaning as well as in the resistance to abrasion of the surface of the photoreceptor by rendering the surface energy state lower, i.e., waterproof. As a result, the prior problems could be overcome by producing a protective layer having a specific chemical structure, i.e., a silicate structure having a uniform chemical composition containing perfluoroalkyl groups.

The electrophotographic photoreceptor comprises an electroconductive substrate having a photoconductor layer and a insulating protective layer formed thereon, characterized in that said protective layer has a silicate structure containing perfluoroalkyl groups.

DETAILED DESCRIPTION OF PREFERRED EMBODIMENTS

For the photoreceptor of the present invention, there may be used any one of substrate from metallic substrates such as electroconductive aluminum, copper, stainless steel and the like, or high molecular weight resins having a thin film of aluminum, vanadium, or the like on the surface thereof.

For the photoconductor layer on the electroconductive substrate, there may be used any one of inorganic photoconductors such as selenium, selenium tellurium compounds, selenium arsenic compounds, cadmium sulfide, amorphous silicon, as well as organic photoconductors. The photoreceptor may be a laminate of a charge-generating layer and a charge-transferring layer formed thereon, or a laminate of a charge-transferring layer and a charge-generating layer formed thereon. The charge-generating layer may be formed with an organic dye such as metallophthalocyanine and azo dyes. Between the charge-generating layer and the substrate may be disposed a barrier layer of metal oxides such as aluminum oxide, or high molecular weight materials such as polyurethane, cellulose and the like. The materials of the charge-transferring layer include high molecular weight materials such as polyvinylcarbazole and polyvinylidene, and substances such as hydrazone derivatives and oxazole derivatives. These may be combined with an adhesive such as polymethylmethacrylate, polycarbonate and polyester to form the layer.

As a protective layer, a silicate layer containing perfluoroalkyl groups is formed on the photoconductor layer as described above. The silicate layer containing perfluoroalkyl groups of the present invention may be formed by dehydrocondensation of a hydrolyzate of a perfluoroalkyl silane coupling agent, or a mixture of a perfluoroalkyl silane coupling agent and a silane coupling agent.

The perfluoroalkyl silane coupling agents include perfluoroalkyl methoxysilanes and perfluoroalkyl ethoxysilanes such as:

γ, γ, γ-trifluoropropyl trimethoxysilane, $CF_3(CH_2)_2Si(OCH_3)_3$, heptafluoropentyl trimethoxysilane, $CF_3(CF_2)_2(CH_2)_2Si(OCH_3)_3$,
nonafluorohexyl methoxysilane, $CF_3(CF_2)_3(CH_2)_2Si(OCH_3)$,
tridecafluoroctyl trimethoxysilane, $CF_3(CF_2)_5(CH_2)_2Si(OCH_3)_3$,
heptadecafluorodecyl methoxysilane, $CF_3(CF_2)_7(CH_2)_2Si(OCH_3)$,
trifluoropropyltriethoxy silane, $CF_3(CH_2)_2Si(OC_2H_5)_3$,
nonafluorohexyl triethoxysilane, $CF_3(CF_2)_3(CH_2)_2Si(OC_2H_5)$,
heneicosafluorodecyl dimethoxysilane, $CF_3(CF_2)_9(CH_2)_2Si(OCH_3)_3$,
trifluoropropyl methyl dimethoxysilane,

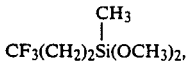

heptadecafluorodecyl methyl dimethoxysilane,

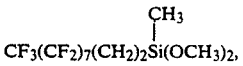

nonafluoropentanoyloxypropyl trimethoxysilane, $CF_3(CF_2)_3COO(CH_2)_3Si(OCH_3)_2$,
pentadecafluoro-octanoyloxypropyl trimethoxysilane, $CF_3(CF_2)_6COO(CH_2)_3Si(OCH_3)_3$,
nonafluoropentanoylthiopropyl trimethoxysilane, $CF_3(CF_2)_3COS(CH_2)_3Si(OCH_3)_3$,
pentadecafluoro-octylamidopropyl trimethoxysilane, $CF_3(CF_2)_6CONH(CH_2)_3Si(OCH_3)_3$,
heptadecafluorodecylthioethyl trimethoxysilane, $CF_3(CF_2)_7(CH_2)_2S(CH_2)_2Si(OCH_3)_3$.

The silane coupling agents to be used with the perfluoroalkyl silane couplings agents include epoxysilanes, alkylsilanes, aminosilanes and vinylsilanes such as:

γ-glycidoxyethyl propyl dipropxysilane

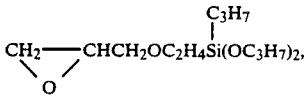

γ-glycidoxyethyl propyl dibutoxysilane

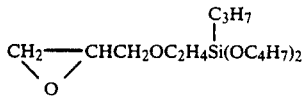

γ-glycidoxypropyl ethyl dimethoxysilane

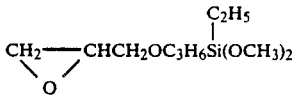

γ-glycidoxypropyl ethyl diethoxysilane

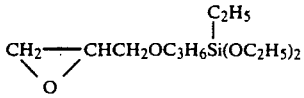

γ-glycidoxypropyl ethyl dipropoxysilane

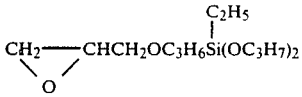

γ-glycidoxypropylethyl dibutoxysilane

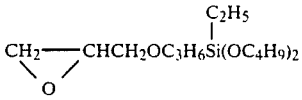

β-(3,4-epoxycyclohexyl)ethyl trimethoxysilane

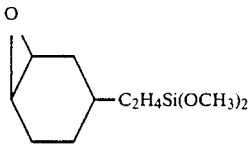

tetramethoxysilane, $Si(OCH_3)_4$,
methyl trimethoxysilane, $CH_3Si(OCH_3)_3$,
dimethyl dimethoxysilane, $(CH_3)_2Si(OCH_3)_2$,
methyl triethoxysilane, $CH_3Si(OC_2H_5)_3$,
dimethyl diethoxysilane, $(CH_3)_2Si(OC_2H_5)_2$,
monoethyl trimethoxysilane, $C_2H_5Si(OCH_3)_3$,
diethyl dimethoxysilane, $(C_2H_5)_2Si(OCH_3)_2$,
monoethyl triethoxysilane, $C_2H_5Si(OCH_2H_5)_3$,
diethyl diethoxysilane, $(C_2H_5)_2Si(OCH_2H_5)_2$,
γ-aminomethyl trimethoxysilane, $H_2NCH_2Si(OCH_3)_3$,
γ-aminomethyl triethoxysilane, $H_2NCH_2Si(OC_2H_5)_3$,
γ-aminomethyl tripropoxysilane, $H_2NCH_2si(OC_3H_7)_3$,
γ-aminopropyl trimethoxysilane, $H_2NC_3H_6Si(OCH_3)_3$,
γ-aminopropyl triethoxysilane, $H_2NCH_3H_6Si(OC_2H_5)_3$,
γ-aminopropyl tributoxysilane, $H_2NC_3H_6Si(OC_4H_9)_3$,
N-β(aminoethyl)-γ-aminopropyl trimethoxysilane, $H_2NC_2H_4NHC_3H_6Si(OCH_3)_3$.

The process of the present invention can be performed by hydrolysis of a perfluoroalkyl silane coupling agent alone, or a mixture of a perfluoroalkyl silane coupling agent and a silane coupling agent. The hydrolysis step converts the perfluoroalkyl silane coupling agents and the silane coupling agents to compounds having a silanol group which are subjected to dehydrocondensation by heating to produce a long chain silicate structure. The silicate structure comprises uniformly perfluoroalkyl chains from the top surface to the bottom so that the surface of the photoreceptor can maintain excellent conditions as to the releasability from mold and the waterproofing property. It has been found for this reason that the photoreceptor has a markedly improved readiness to cleaning as to removal of the remaining toner, sheet dust from transfering sheets and other contaminants due to corona charges attached on the surface of the photoreceptor after the transfering operation. In addition, it has been also found that the structure has a great effect on the resistance to abrasion.

According to the present invention, the protective layer can contain an effective amount of the perfluoroalkyl silane coupling agents, preferably 1 to 100 % by weight. An amount of 0.5 % b weight or less can not fully exhibit the effect desired in the present invention. The protective layer according to the present invention has suitably a thickness of 0.1 to 3 μm, preferably 0.3 to 2 μm.

As discussed above, the present invention can form the silicate protective layer of the uniform chemical structure containing perfluoroalkyl groups on the photoconductive layer making the surface energy level of the photoreceptor lower, i.e., rendering the surface highly releasable from a mold and water proof, improving the readiness to cleaning as to removal of contaminants attached on the surface of the photoreceptor such as the remaining toner and dust from transferring sheets after the electrophotographic operations. As a result, the present invention can provide the photoreceptor having a high stability in various environments from a higher temperature and humidity condition to a lower one, a higher resistance to the abrasions with a considerable amount of sheets and the cleaning members, and being capable of producing higher resolution and quality images without any blurring and no spreading of the images. Thus, the present invention can achive a great effect.

The present invention will be further explained in detail with reference to the following non limiting Examples.

EXAMPLE 1

To 20 parts by volume of γ, γ,γ-trifluoropropyl trimethoxysilane and 5 parts by volume of water was added one part by volume of hydrochloric acid with stirring to proceed a hydrolysis reaction. Then, 75 parts by volume of methanol were added to control the concentration. The resulting solution was applied onto a conventional photoreceptor comprising an aluminum substrate having a selenium layer deposited thereon, followed by heating at a temperature of 50° C. for 24 hours to form a protective layer. This protective layer has a pencil hardness of 6H. The protective layer had a thickness of 8 μm.

As a result of applying the conventional electrophotographic operation consisting of charging, exposing to the light, developing, transferring and cleaning, it was found that the photoreceptor of the present invention could produce high quality images without any image blurring and spread under a higher temperature and humidity condition and be in the sufficiently repeatedly usable state even after 120,000 sheets were printed.

EXAMPLE 2

A mixture of 5 parts by volume of γ-glycidoxyethylpropyl dipropoxysilane, 10 parts by volume of aminomethyl trimethoxysilane, 5 parts by volume of 1H,1H,2H,2H-perfluoro-octyl trimethoxysilane and 5 parts by volume of water was subjected to a hydrolysis reaction with stirring. After the reaction, 100 parts by volume of ethanol were added to prepare a solution.

The resulting solution was applied onto a conventional photoreceptor comprising an aluminum substrate having a selenium layer deposited thereon, followed by heating at a temperature of 50° C. for 24 hours to form a protective layer. This protective layer has a pencil hardness of 8H. The protective layer had a thickness of 1.5 μm. As a result of applying the conventional electrophotographic operation, it was found that the photoreceptor of the present invention could produce high quality images without any image disturbance such as blurring under a higher temperature and humidity condition even after 80,000 sheets were printed.

EXAMPLE 3

A mixture of 35 parts by volume of γ-glycidoxyethylpropyl diethoxysilane, 12 parts by volume of monomethyl triethoxysilane, 12 parts by volume of aminomethyl tripropoxysilane, 6 parts by volume of γ,γ,γ-trifluoropropyl trimethoxysilane and 10 parts by volume of water was subjected to a hydrolysis reaction with stirring. After the reaction, 170 parts by volume of ethanol were added to control the solution.

The resulting solution was applied onto a photoreceptor comprising an aluminum substrate having a selenium layer deposited thereon, followed by heating at a temperature of 50° C. for 24 hours to form a hydrolyzate protective layer. This protective layer has a pencil hardness of 8H. The protective layer had a thickness of 1 μm. The application of the conventional electrophotographic operation lead to the identical results as those in Example 1.

EXAMPLE 4

To a mixture of 50 parts by volume of β-(3,4-epoxycyclohexyl)ethyl trimethoxysilane, 10 parts by volume of tetramethoxysilane, 10 parts by volume of dimethyl dimethoxysilane, 10 parts by volume of γ-aminopropyl triethoxysilane, 10 parts by volume of γ,γ,γ-trifluoropropyl trimethoxysilane and 15 parts by volume of water was added one part by volume of hydrochloric acid and subjected to a hydrolysis reaction with stirring. After the reaction, 250 parts by volume of ethanol were added to prepare a solution.

The resulting solution was applied onto an organic photoreceptor disposed on an aluminum substrate, followed by heating at a temperature of 100° C. for 4 hours to form a protective layer. The protective layer had a thickness of 1.2 μm.

The organic photoreceptor without such a protective layer was abraded b 5.5 μand exhibited a degradation in electrification due to ozone after 100,000 sheets were printed. In contrast, the organic photoreceptor with the protective layer showed no abrasion preserving the good imaging and electrification properties identical to those at the beginning even after 100,000 copes were produced.

COMPARATIVE EXAMPLE 1

40 parts by volume of polymethylmethacrylate (PMMA) were dissolved in 100 parts by volume of tetrahydrofuran with well stirring. To the resulting mixture was added 10 parts by volume of γ,γ,γ-trifluoropropyl trimethoxysilane with stirring to prepare a solution. The resulting solution was applied onto a conventional photoreceptor comprising an aluminum substrate having a selenium layer vapor-deposited thereon, followed by heating at a temperature of 50° C. for 30 minutes to form a transeparent protective layer having a thickness of 1 μm. (In this reaction, no polycondensation through hydrolysis occurred.) As a result of applying the conventional electrophotographic operation, it was found that after copying 10,000 sheets, the photoreceptor had scratches on the surface thereof which scratches revealed black lines on the images and the background which had been white at the beginning was fogged after 10,000 sheets were printed.

COMPARATIVE EXAMPLE 2

A mixture of 30 parts by volume of β-(3,4-epoxycyclohexyl)ethyl trimethoxysilane, 20 parts by volume of N-type-β(aminoethyl)γ-aminopropyl trimethoxysilane, 3 parts by volume of acrylate resin having perfluoroalkyl groups (trademark S-382, Asahi Glass Co. Japan) and 5 parts by volume of water was subjected to a hydrolysis reaction with stirring. After the reaction, 100 parts by volume of isopropyl alcohol were added to prepare a solution.

The resulting solution was applied on to a conventional photoreceptor comprising an aluminum substrate having a selenium layer deposited thereon, followed by heating at a temperature of 50° C. for 24 hours to form a protective layer having a thickness of 1.5 μm. As a result of applying the conventional electrophotographic operation, it was found that the photoreceptor produced grazings on the images from the beginning.

COMPARATIVE EXAMPLE 3

10 parts by volume of β-glycidoxyethylpropyl diebutoxysilane, 10 parts by volume of monoethyl triethoxysilane, 10 parts by volume of aminopropyl triethoxysilane were mixed, then mixed with 10 parts by volume of water and subjected to a hydrolysis reaction with stirring. After the reaction, 100 parts by volume of methanol were added to prepare a solution for use in formation of a protective layer.

The resultant solution was applied onto a photoreceptor comprising an aluminum substrate having a selenium layer vapor-deposited thereon, followed by heating at a temperature of 50° C. for 24 hours to form a protective layer. The protective layer has a pencil hardness of 8H. The protective layer had a thickness of 0.8 μm.

As a result of applying the conventional electrophotographic procedure including charging, exposing to the light, developing, transferring and cleaning, the image blurring began at a temperature of 35° C. and at a humidity of 80 % after copying 50,000 sheets.

What is claimed is:

1. In an electrophotographic photoreceptor comprising an electroconductive substrate having a photoconductive layer disposed thereon and a top insulating protective layer, the improvement wherein said protective layer has a silicate structure containing perfluoroalkyl groups, in which said silicate structure is formed by dehydro-condensation of a hydrolyzate of a perfluoroalkyl silane coupling agent.

2. In an electrophotographic photoreceptor comprising an electroconductive substrate having a photoconductive layer disposed thereon and a top insulating protective layer, the improvement wherein said protective layer has a silicate structure containing perfluoroalkyl groups, in which said silicate structure is formed by dehydro-condensation of a hydrolyzate of a mixture of a perfluoroalkyl silane coupling agent and a silane coupling agent.

3. The electrophotographic photoreceptor according to claim 1, in which said perfluoroalkyl silane coupling agent is at least one silane compound selected from a group consisting of γ,γ,γ-trifluoropropyl trimethoxysilane, 1H,1H,2H,2H-perfluoro-octyl trimethoxysilane and γ,γ,γ-trifluoropropyl triethoxysilane.

4. The electrophotographic photoreceptor according to claim 2, in which said perfluoroalkyl silane coupling agent is at least one silane compound selected from a group consisting of γ,γ,γ-trifluoropropyl trimethoxysilane, 1H,1H,2H,2H-perfluoro-octyl trimethoxysilane and γ,γ,γ-trifluoropropyl triethoxysilane.

5. The electrophotographic photoreceptor according to claim 2, in which said silane coupling agent is at least one silane compound selected from a group consisting of tetramethoxysilane, dimethyl dimethoxysilane, monomethyl triethoxysilane, γ-glycidoxyethylpropyl diethoxysilane, γ-(3,4,-epoxycyclohexyl)ethyl trimethoxysilane, γ-glycidoxyethylpropyl dipropoxysilane, aminomethyl trimethoxysilane, γ-aminopropyl triethoxysilane and aminomethyl tripropoxysilane.

6. The electrophotographic photoreceptor according to claim 2, in which said perfluoroalkyl silane coupling agent is γ,γ,γ-trifluoropropyl trimethoxysilane and said silane coupling agent consists of tetramethoxysilane, dimethyl dimethoxysilane, β-(3,4-epoxycyclohexyl-)ethyl trimethoxysilane and γ-aminopropyl triethoxysilane.

7. The electrophotographic photoreceptor according to claim 1, in which said perfluoroalkyl silane coupling agent is at least one member selected from the group consisting of perfluoroalkyl methoxysilane compounds and perfluoroalkyl ethoxysilane compounds.

8. The electrophotographic photoreceptor according to claim 2, in which said perfluoroalkyl silane coupling agent is at least one member selected from the group consisting of perfluoroalkyl methoxysilane compounds and perfluoroalkyl ethoxysilane compounds.

* * * * *